US010003891B2

(12) United States Patent
Siegumfeldt et al.

(10) Patent No.: US 10,003,891 B2
(45) Date of Patent: Jun. 19, 2018

(54) POWER MANAGEMENT SYSTEM FOR A HEARING AID

(71) Applicant: GN HEARING A/S, Ballerup (DK)

(72) Inventors: Peter Siegumfeldt, Frederiksberg (DK); Henrik Ahrendt, Solroed Strand (DK); Jan Tomas Matys, Soeborg (DK)

(73) Assignee: GN Hearing A/S, Ballerup (DK)

( * ) Notice: Subject to any disclaimer, the term of this patent is extended or adjusted under 35 U.S.C. 154(b) by 9 days.

(21) Appl. No.: 14/145,520

(22) Filed: Dec. 31, 2013

(65) Prior Publication Data

US 2015/0189448 A1 Jul. 2, 2015

(51) Int. Cl.
*H04R 25/00* (2006.01)
*H04R 1/10* (2006.01)

(52) U.S. Cl.
CPC ..... *H04R 25/30* (2013.01); *H04R 1/1025* (2013.01); *H04R 25/602* (2013.01); *H04R 2460/03* (2013.01)

(58) Field of Classification Search
CPC ..... H04R 25/602; H04R 1/1025
USPC ..... 381/323
See application file for complete search history.

(56) References Cited

U.S. PATENT DOCUMENTS 5,767,657 A * 6/1998 Oglesbee ..... 320/101
6,150,805 A * 11/2000 Rapp ..... 323/315
2008/0238378 A1* 10/2008 Uan-Zo-li et al. ..... 323/249
2009/0015332 A1* 1/2009 Oberhuber ..... H03F 1/30 330/261
2011/0211717 A1* 9/2011 Hoevesteen ..... 381/323
2012/0091975 A1* 4/2012 Trojer ..... 323/234
2013/0169247 A1* 7/2013 Onouchi ..... G05F 1/59 323/269
2013/0232351 A1* 9/2013 Gunther ..... G06F 1/20 713/300

OTHER PUBLICATIONS

Dual-voltage regulator meets USB-power needs. Wayne Rewinkel, National Semiconductor, Phoenix, AZ—Aug. 19, 2004.

* cited by examiner

*Primary Examiner* — Sean H Nguyen
(74) *Attorney, Agent, or Firm* — Vista IP Law Group, LLP

(57) ABSTRACT

An apparatus for a hearing device includes a first voltage regulator with an output terminal; a first voltage reference; a second voltage regulator with an output terminal; a switching element; and a decoupling element; wherein the switching element and the decoupling element are operatively between the first voltage reference and the first voltage regulator; wherein the output terminal of the first voltage regulator shares a same electrical node as the output terminal of the second voltage regulator; and wherein the first voltage regulator is configured to provide a first output voltage in response to applied battery power, the second voltage regulator is configured to provide a second output voltage if a certain condition is fulfilled, and the switching element is configured to disconnect the first voltage reference from the decoupling element if the condition is fulfilled.

41 Claims, 4 Drawing Sheets

POWER MANAGEMENT SYSTEM FOR A HEARING AID

FIELD

This application relates to hearing aids. More specifically, it relates to battery-powered hearing aids comprising integrated electronic circuits.

BACKGROUND

The electronic circuits in contemporary hearing aids are usually powered by batteries, e.g. rechargeable batteries of the lithium-ion or lithium-polymer variety, or non-rechargeable zinc-air batteries. A typical hearing aid circuit operates at a voltage of about one volt and draws a current of between 1 mA and 10 mA. A hearing aid user would want to change the batteries in his or her hearing aids as rarely as possible, e.g. one to three times a week. In order to prolong battery life, hearing aid designers therefore strive to reduce current consumption as much as possible when devising new hearing aids. The supply voltage in a hearing aid has to be maintained within narrow limits in order to ensure stable and proper operation of the hearing aid signal processing circuit, while the current consumption is kept at a minimum.

Prior art hearing aids are powered by a switching or linear voltage regulator providing a stable and accurate voltage to the electronic circuit in the hearing aid. In hearing aids comprising radio receivers, linear voltage regulators are generally preferred for power supplies over switching voltage regulators because they emit much less high-frequency electromagnetic noise. In this context, a linear voltage regulator is considered as an electronic circuit comprising a voltage reference, an operational amplifier, an amplifying element such as a transistor, and a voltage divider circuit. The voltage regulator is powered by a voltage source such as a battery, and a biasing voltage generator is providing a proper operating point for the operational amplifier.

Proper and stable operation of the signal processing circuit in a contemporary, digital hearing aid is highly dependent on a stable and reliable power supply. A deviation of more than 5% from the nominal supply voltage may easily present a problem to e.g. the digital-to-analog converters present in the hearing aid, since the conversion of an input voltage to a digital number may go astray if e.g. the internal voltage reference of the analog-to-digital converter or the input voltage deviates as a result of an unstable supply voltage. An unstable supply voltage may also introduce noise and distortion into the analog parts of the signal processor due to changes in the operating points of the amplifying semiconductor elements. Even worse, it may cause the program execution of the digital signal processor to crash or fail. In order for the power supply to be stable within 2-5% of the nominal supply voltage, a very stable voltage reference circuit must be provided.

Dual voltage regulator circuits are known from the prior art, e.g. from the article "Dual-voltage regulator meets USB-power needs", by Wayne Rewinkel of National Semiconductor, published in EDN online magazine, August 2004. The dual voltage regulator disclosed by Rewinkel does not provide an output voltage to a common output node, and does not teach a handover procedure between the two regulators.

SUMMARY

A good choice of reference voltage is a band-gap reference due to the inherent high stability and temperature independence. The electronics in a microelectronic circuit in a hearing aid typically operates at voltages around one volt. However, since a band-gap voltage reference has a typical reference voltage of 1.25 volts, and a typical battery in a hearing aid is only capable of delivering 1.3 volts at the most, more typically 1.1 to 1.2 volts, a band-gap voltage reference cannot be fed directly from a hearing aid battery. A higher supply voltage could be provided, e.g. a double voltage provided by a voltage doubler circuit, but a double voltage generator would be dependent on a clock generator driven by the output voltage and running at a nominal frequency and output voltage swing from the moment the output voltage of the power supply was applied to the circuit. Such an oscillator is not feasible given the current state of technology and the power limitations of a hearing aid circuit. The oscillator would need at least 2-3 milliseconds to start up in order to be able to reach the required stability, frequency and voltage swing, and an associated voltage doubler circuit would require an additional period of 2-3 milliseconds in order to be capable of providing a sufficiently stable doubled battery voltage without drawing an inhibitory large amount of power.

A doubled battery voltage would also be of benefit to the operational amplifier present in the linear voltage regulator, since this would allow for an amplifier design with a larger open loop gain, and thereby be able to provide a yet more stable voltage regulator circuit capable of powering a wider range of loads. As indicated, such a voltage regulator would need a start-up time of 4-6 milliseconds in order to provide the desired power and precision. This voltage regulator is therefore not capable of powering a hearing aid from the moment battery power is applied.

A voltage regulator capable of delivering a desired output voltage immediately after being powered on would have to be a compromise on a number of features essential to the desired accuracy of the supply voltage due to the fact that no doubled voltage is available at that moment. For instance, the voltage reference could be a simple voltage reference such as a Zener diode or a current mirror. This choice would reduce the precision of the supplied voltage but would be capable of delivering a sufficient supply voltage immediately after applying power to the circuit, e.g. when the battery door is closed. Furthermore, the operational amplifier of this voltage regulator could be powered directly by the battery voltage at the cost of a lower open loop gain and a reduced power capability.

A hearing aid having a power supply comprising two distinct voltage regulators, one featuring the required precision and one being capable of operating from the moment power is applied, is proposed. Such a design, however, presents the designer with a number of nontrivial problems. These problems are solved by the power supply of the disclosure.

A power supply for a hearing device is provided, the power supply comprising a battery, a first linear voltage regulator, a first voltage reference, a second linear voltage regulator, a second voltage reference, wherein the output terminal of the first linear voltage regulator sharing the same electrical node as the output terminal of the second linear voltage regulator, a switching element and a decoupling element, said switching element and decoupling element being positioned between the first voltage reference and the first linear voltage regulator, and wherein the first linear voltage regulator is capable of providing a first output voltage when battery power is applied, the second voltage regulator is capable of providing a second output voltage on the fulfillment of a specific condition, and the switching element is capable of disconnecting the first voltage reference from the decoupling element if the specific condition is fulfilled. In this way a practical and reliable power supply for a hearing aid is realized.

In one embodiment, the specific condition is that a predetermined time period has elapsed since battery power was applied to the circuit. The elapsed time period may be measured and conveyed in a number of ways known in the art, such as a delay circuit detecting the presence of the battery voltage, a digital counter starting together with the hearing aid processor, or a dedicated timing circuit. When the time period has elapsed, this circuit controls the switching element, thus disconnecting the first voltage reference from the decoupling element.

In another embodiment, the specific condition is the presence of a predetermined voltage level at a specified node in the circuit. If the specified node is e.g. connected to a voltage doubler providing the double voltage of the battery the presence of this voltage could be detected, e.g. with a 1:2 voltage divider circuit and a comparator. When the voltage output from the voltage doubler equals the double battery voltage, the voltage output from the 1:2 voltage divider equals the battery voltage. This condition could then be tested by a comparator comparing the output voltage from the 1:2 voltage divider to the battery voltage. The output from the comparator could then be used to control the switching element directly, thus disconnecting the first voltage reference from the decoupling element when the voltage doubler is operating nominally, and the first linear voltage regulator therefore is no longer needed.

In an embodiment, the timing constant of the decoupling element is larger than, or equal to, the timing constant of the control loop of the second linear voltage regulator. In this way, the second regulator may take over the supply of power gently from the first voltage regulator when the first voltage regulator is no longer needed by the circuit.

The motivation behind the power supply according to the disclosure is born out of the desire to have both a fast power supply and a precise power supply in the hearing aid. This may be obtained by providing the hearing aid circuit with a power supply comprising two linear voltage regulators, where a first voltage regulator is capable of operating immediately after applying battery power to the hearing aid and a second voltage regulator is capable of providing a very precise supply voltage after a few milliseconds. The first voltage regulator thus has the advantage of being available immediately after powering on the hearing aid and the second voltage regulator has the advantage of delivering a voltage with an accuracy within 2% of the nominal supply voltage. Furthermore the first voltage regulator has the limitation of providing a voltage with an accuracy within 20% of the nominal supply voltage, and the second voltage regulator has the limitation of not being available immediately after powering up the hearing aid.

If the two voltage regulators are designed to provide approximately the same voltage, they may operate concurrently for a short period of time, i.e. when the second voltage regulator is operating safely. In order to save power it is beneficial to shut down the first voltage regulator when the second voltage regulator is operating safely. This may be done by disconnecting the voltage reference from the first operational amplifier of the voltage regulator, effectively driving its output to zero volts. Such a disconnection may effectively be obtained by a transistor acting as a voltage-controlled switch. However, if the reference voltage is removed instantly whenever the first voltage regulator is no longer needed, the second voltage regulator will temporarily experience a big voltage drop due to the fact that the first voltage regulator suddenly does not supply current to the load anymore, and the second voltage regulator therefore has to deliver all current consumed by the load. Since this is a temporary situation, the second voltage regulator will eventually be able to deliver the extra load current. However, the control loop of the second voltage regulator cannot keep up with the sudden current demand. The cause is that the intrinsic slew rate of the second voltage regulator sets an upper limit to how fast the load current may change.

In order to alleviate this problem, a discharging circuit is inserted between the voltage reference and the positive input of the operational amplifier of the voltage regulator. The purpose of this circuit is to provide a voltage decreasing with a lower speed than the highest possible regulation speed of the control loop of the second voltage regulator as defined by the slew rate. Preferably, the circuit comprises a capacitor in parallel with a semiconductor having a low leakage current, both connected to ground.

Thus, the condition which must be satisfied by the discharging circuit is:

$$\frac{\partial V_C}{\partial t} \geq \frac{\partial V_R}{\partial t} \tag{1}$$

where $\partial V_C$ is the time constant of the capacitor discharge circuit and $\partial V_R$ is the slew rate time constant of the operational amplifier. Equation (1) states that if the time constant of the capacitor discharge circuit is larger than the slew rate of the operational amplifier, the second voltage regulator will be able to maintain a stable output voltage when the first voltage regulator ceases to deliver current to the load.

When the simple voltage reference is connected to the capacitor and the semiconductor of the discharging circuit and the input of the operational amplifier, the capacitor is charged to the same voltage as the voltage reference. The low leakage current of the semiconductor does not affect the reference voltage as long as the reference is connected, and the operational amplifier is designed in such a way that no significant current is flowing into the input node of the operational amplifier. When the voltage reference is disconnected by the voltage-controlled switch, the capacitor is discharged through the semiconductor, thus providing the slowly decreasing voltage needed in order to prevent the power surge which would otherwise result in a drop in the supply voltage from the second voltage regulator.

An apparatus for a hearing device includes a first voltage regulator with an output terminal; a first voltage reference; a second voltage regulator with an output terminal; a switching element; and a decoupling element; wherein the switching element and the decoupling element are operatively between the first voltage reference and the first voltage regulator; wherein the output terminal of the first voltage regulator shares a same electrical node as the output terminal of the second voltage regulator; and wherein the first voltage regulator is configured to provide a first output voltage in response to applied battery power, the second voltage regulator is configured to provide a second output voltage if a certain condition is fulfilled, and the switching element is configured to disconnect the first voltage reference from the decoupling element if the condition is fulfilled.

Optionally, the decoupling element comprises a capacitor and a semiconductor element.

Optionally, the switching element is a semiconductor switching element.

Optionally, the condition is that a predetermined time period has elapsed since an application of battery power.

Optionally, the predetermined time period is anywhere from 3 ms to 10 ms.

Optionally, the predetermined time period is anywhere from 4 ms to 6 ms.

Optionally, the condition is a presence of a predetermined voltage level at a specified node in the apparatus.

Optionally, the predetermined voltage level is a multiple of a nominal battery voltage.

Optionally, the first voltage reference is a current mirror voltage reference.

Optionally, the apparatus further includes a second voltage reference, wherein the second voltage reference is a band-gap voltage reference.

Optionally, the second voltage regulator is configured to provide a more precise output voltage than the first voltage regulator.

Optionally, a timing constant of the decoupling element is larger than, or equal to, a timing constant of a control loop of the second voltage regulator.

Optionally, the second output voltage provided by the second voltage regulator deviates less than 2% from a nominal output voltage.

Other and further aspects and features will be evident from reading the following detailed description.

BRIEF DESCRIPTION OF THE FIGURES

The above and other features and advantages will become readily apparent to those skilled in the art by the following detailed description of exemplary embodiments thereof with reference to the attached drawings, in which.

DETAILED DESCRIPTION

Various embodiments are described hereinafter with reference to the figures. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

Figure 1:
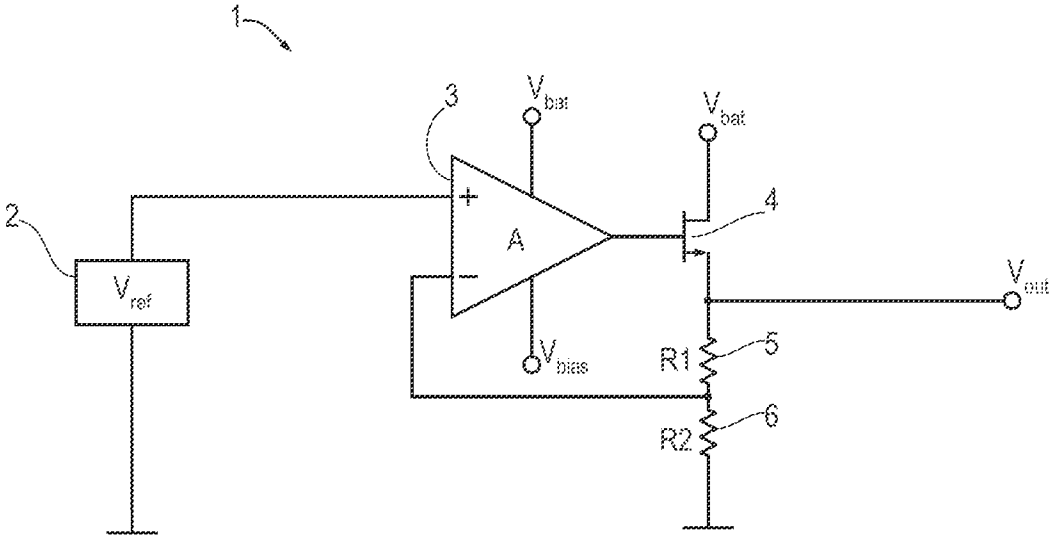
PRIOR ART FIG. 1
FIG. 1 is an exemplary schematic diagram of a prior art hearing aid power supply.

FIG. 1 shows a prior art hearing aid power supply 1. The power supply 1 comprises a voltage reference 2, an operational amplifier 3, a MOSFET output transistor 4, a first resistor 5 and a second resistor 6. The voltage reference 2 provides the reference voltage $V_{ref}$ and is connected to the positive input of the operational amplifier 3, the output of the operational amplifier 3 is connected to the gate terminal of the output transistor 4, the drain terminal of the output transistor 4 is connected to a battery voltage terminal $V_{bat}$, the source terminal of the output transistor 4 is connected to an output terminal $V_{out}$ of the power supply and the first terminal of the first resistor 5, the second terminal of the first resistor 5 is connected to the first terminal of the second resistor 6 and the negative input terminal of the operational amplifier 3, and the second terminal of the second resistor 6 is connected to ground. The operational amplifier 3 has a supply terminal connected to the battery voltage terminal $V_{bat}$ and a biasing terminal $V_{bias}$ connected to a biasing voltage source (not shown).

As used in this specification, the term "voltage reference" refers to any component that is capable of providing a reference voltage (e.g., a stable reference voltage). In its simplest form, a voltage reference may be e.g. a Zener diode connected to a voltage source. A more advanced and precise voltage reference may be, e.g., a band-gap voltage reference connected to a voltage source. However, embodiments described herein are not limited to these examples of voltage reference. Different voltage references have various benefits and shortcomings, which are discussed in greater detail in the following.

The operational amplifier is connected in a noninverting configuration, and the output voltage $V_{out}$ of the operational amplifier 3 is:

$$V_{out} = V_{ref}\left(1 + \frac{R1}{R2}\right) \tag{2}$$

where $V_{ref}$ is the voltage of the reference 2.

The load regulation, defined as the change in output voltage $\Delta V_{out}$ as a function of a static change in the current load $\Delta I_{load}$ may be written as:

$$\Delta V_{out} = -\frac{\Delta I_{load}}{\left(\frac{R2}{R1 + R2} \cdot A + 1\right) g_M} \tag{3}$$

where $g_M$ is the transconductance of the transistor 4 and A is the open-loop gain of the amplifier 3. In other words, if the current load changes, the regulated voltage also changes.

As indicated by equation (3), a change in the load current $\Delta I_{load}$ has a direct influence on the change of the output voltage $\Delta V_{out}$. If, e.g. the load current suddenly rises, this would result in a drop in the output voltage. The relative magnitude of the voltage drop is directly dependent on the value of the resistors 5 and 6, the open-loop gain of the operational amplifier 3 and the transconductance of the transistor 4.

Figure 2:
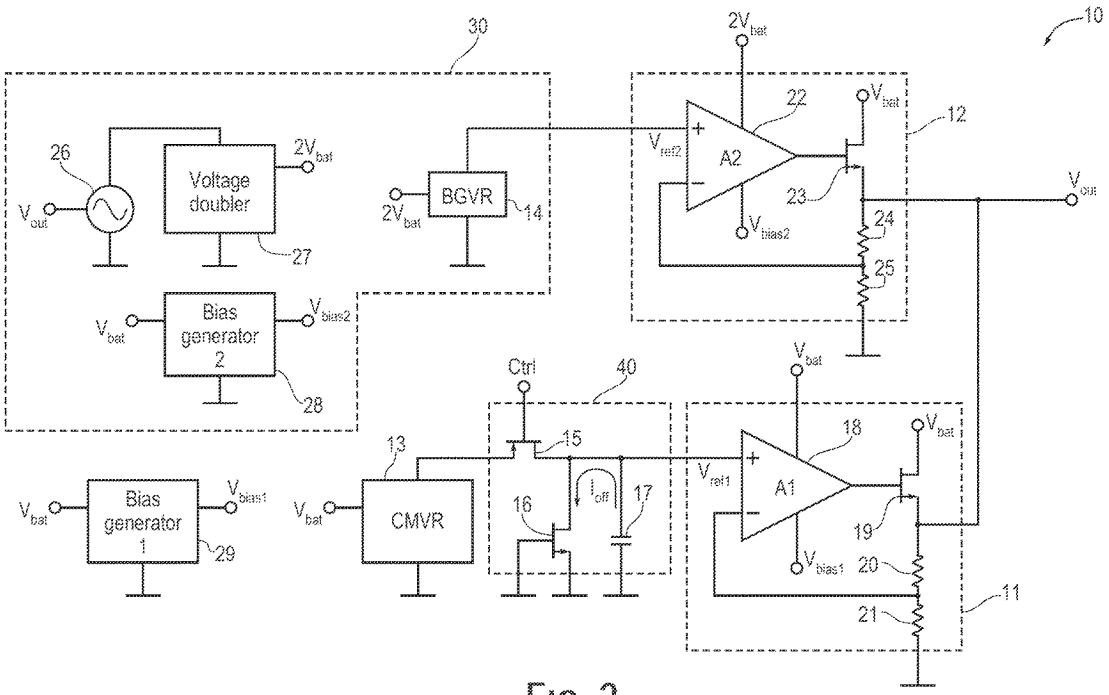
FIG. 2 is an exemplary schematic diagram of a power supply comprising a dual linear voltage regulator according to the disclosure.

FIG. 2 illustrates a new exemplary dual linear voltage regulator power supply 10. The power supply 10 comprises a first voltage regulator 11 and a second voltage regulator 12, both delivering an output voltage to the terminal $V_{out}$. The first voltage regulator 11 comprises a first operational amplifier 18, a first output transistor 19, a first resistor 20, and a second resistor 21. The operating point of the first operational amplifier 18 is controlled by a first bias voltage generator 29 delivering a first bias voltage to the terminal $V_{bias1}$. The first voltage regulator 11 is powered by the battery voltage and controlled by a simple voltage reference 13 connected to the non-inverting input of the first operational amplifier 18 via a discharging circuit 40. The discharging circuit 40 comprises a voltage-controlled transistor switch 15, a low-leakage current transistor 16 and a capacitor 17.

The second voltage regulator 12 comprises a second operational amplifier 22, a second output transistor 23, a third resistor 24 and a fourth resistor 25. Also shown in FIG. 2 is a slow-reacting subcircuit 30. The subcircuit 30 comprises a master clock oscillator 26, a voltage doubler circuit 27, a band-gap voltage reference 14 and a second bias voltage generator 28. The voltage doubler circuit 27 provides a doubled battery voltage to the terminal $2V_{bat}$, and the second bias voltage generator 28 controls the operating point of the second operational amplifier 22 by providing a second bias voltage to the terminal $V_{bias2}$. The doubled battery voltage from the terminal $2V_{bat}$ is used by the band-gap voltage reference 14 and the second operational amplifier 22.

The various parts of the subcircuit 30 have the inherent property of not being operational until a definite amount of time, e.g. 6-8 milliseconds, has elapsed from the moment when battery power is applied to the subcircuit 30, the reasons for this being, among other things, that the master clock oscillator 26 has to reach a stable output frequency and output voltage swing. The master clock oscillator 26 is driven by $V_{out}$ (at this moment in time delivered by the first voltage regulator 11) for producing an oscillating output voltage. Since the master clock oscillator 26 drives the voltage doubler circuit 27, and the voltage doubler circuit 27 in turn drives the band-gap voltage reference 14 and the second bias voltage generator 28, the subcircuit 30 needs to have power applied for a period of about 6-8 milliseconds in order to be fully functional.

When in use, the exemplary power supply in FIG. 2 works in the following way; When battery power is applied to the circuit, the voltage-controlled transistor switch 15 of the discharging circuit 40 is closed, allowing the simple voltage reference 13 to provide a first reference voltage $V_{ref1}$ to the first voltage regulator 11, which then delivers a regulated voltage to the output terminal $V_{out}$. The first voltage regulator 11 is not very accurate. In one embodiment, it delivers a regulated supply voltage level of approximately 1100 mV±230 mV, i.e. with a long-term accuracy of about 20%. The exact magnitude of this output voltage is dependent on a number of factors such as the ambient temperature, the condition of the battery, the amount of power initially drawn from the hearing aid circuit and chip fabrication tolerances. However, for the purpose of starting up the hearing aid circuit and initially providing it with power, it is considered sufficiently adequate.

In order to regulate the supply voltage more accurately, the second voltage regulator 12 is supposed to take over from the first voltage regulator 11 when the aforementioned subcircuit 30 is considered to be operating nominally. In the embodiment shown in FIG. 2, this is accomplished by determining if a predetermined period of time has elapsed since the hearing aid was powered up. Typically, this occurs within 5 ms from the moment battery power is applied. At this point in time, the band-gap voltage reference delivers a second reference voltage to the terminal $V_{ref2}$ connected to the noninverting input of the second operational amplifier 22. The second voltage regulator 12 is designed to provide a regulated supply voltage level of about 900 mV±20 mV, i.e. an accuracy of about 2%, or approximately ten times better than the accuracy of the output voltage from the first voltage regulator 11. When the second voltage regulator 12 is operative, the voltage output from the first voltage regulator 11 is no longer needed, and the first voltage regulator 11 may be turned off in order to conserve battery power.

Obviously, the first voltage regulator 12 could be turned off simply by disconnecting the first voltage reference 13 from the noninverting input of the operational amplifier 18. This would, however, present the output of the second voltage regulator 12 with a sudden rise in required output current, which again would lead to a big drop in the voltage supplied by the second voltage regulator 12, the supply voltage at the output terminal $V_{out}$ only rising back to the nominal voltage level again as fast as the control loop of the second voltage regulator 12 would permit. This would leave the parts of the hearing aid circuit supplied by this lower voltage in a potentially hazardous situation, since e.g. the signal processing circuits of the hearing aid are very susceptible to dropouts in the supply voltage, as stated in the foregoing.

In order to prevent this problem, the discharging circuit 40 of the power supply 10 is placed between the simple voltage reference 13 and the noninverting input of the first operational amplifier 18. The output terminal of the simple voltage reference 13 of the discharging circuit 40 is connected on the input side of the voltage-controlled transistor switch 15. The low-leakage current transistor 16 has its gate and source terminals connected to ground and its drain terminal connected on the output side of the voltage controlled transistor switch 15, and the capacitor 17 is connected between the drain terminal of the low-leakage current transistor 16 and ground. The voltage-controlled switch 15 controls the connection between the simple voltage reference 13 and the noninverting input of the first operational amplifier 18, and the low-leakage current transistor 16 in parallel with the capacitor 17 performs a discharging function when the voltage-controlled switch 15 is opened.

When a sufficient time period has elapsed from the moment of applying battery power to the hearing aid circuit to the moment in time where the slow-reacting subcircuit 30 is considered to be operating nominally, a signal to the input gate of the voltage-controlled transistor switch 15 disconnects the first reference voltage $V_{ref1}$ of the simple voltage reference 13 from the noninverting input of the first operational amplifier 18. The capacitor 17 will leak its charge slowly through the low-leakage current transistor 16 as a discharge current $I_{off}$, resulting in the reference voltage $V_{ref1}$ decreasing over time. The voltage contribution from the first voltage regulator 11 is thus reduced gradually when the first voltage reference 13 is disconnected.

The reduction rate of the voltage contribution from the first voltage regulator 11 has to be sufficiently slow for the control loop of the second voltage regulator 12 to be able to compensate, the second voltage regulator 12 thereby being capable of maintaining the required stable supply voltage for powering the rest of the hearing aid circuit. This is achieved by optimizing the transistor 16 for having a low, but well-defined leakage current $I_{leak}$. If the first operational amplifier 18 and the voltage-controlled switch 15 are considered ideal, the capacitor will only leak its charge through the transistor 16, thus:

$$I_{leak}=I_{off} \tag{4}$$

The voltage level presented to the noninverting output of the operational amplifier 18 is thus defined by:

$$V_{ref1}(t)=\frac{1}{C}\int_{t_{off}}^{\infty} I_{off}(t)\,dt+V_{ref1}(t_{off}) \tag{5}$$

Where $t_{off}$ is the time when the voltage-controlled switch 15 is opened. In a practical circuit, the discharge process will end when $V_{ref1}$ reaches the pinch-off level of the transistor 16. However, this level is sufficiently low for the resulting contribution from the first voltage regulator 11 to be negligible.

Figure 3:
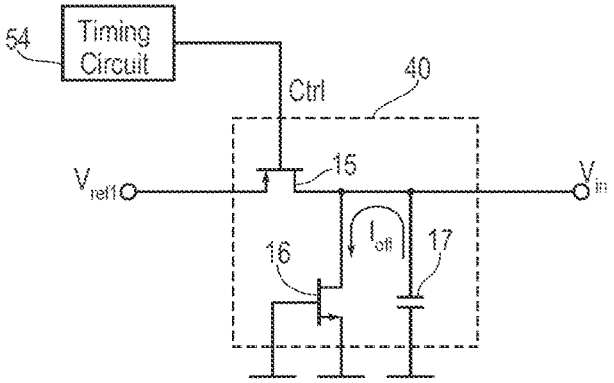
FIG. 3 is an exemplary schematic diagram of a discharging circuit of the dual linear voltage regulator in FIG. 2.

FIG. 3 shows an exemplified discharging circuit 40 of the double voltage regulator 10 shown in FIG. 2. The discharging circuit 40 comprises the voltage-controlled transistor switch 15, the low-leakage current transistor 16 and the capacitor 17. The source terminal of the voltage-controlled switch 15 is connected to the output of the simple voltage reference 13 (see FIG. 2) providing the reference voltage to the input terminal $V_{ref1}$. The drain of the voltage-controlled transistor switch 15 is connected to the noninverting input of the first operational amplifier 18 (see FIG. 2) and providing the reference voltage to the output terminal $V_{in}$. The drain of the low-leakage current transistor 16, a first terminal of the capacitor 21 and the gate of the low-leakage current transistor 16 are sharing the same node as the drain of the voltage-controlled transistor switch 15. The gate of the voltage-controlled transistor switch 15 is connected to the output of a timing circuit 54. The gate and the source of the low-leakage current transistor 16 are connected to ground, and a second terminal of the capacitor 17 is also connected to ground. For the sake of simplicity, the voltage-controlled transistor switch 15 is considered to be an ideal switch, i.e. providing no resistance when closed and infinite resistance when open.

When power is applied to the hearing aid circuit, e.g. by applying a battery voltage to the circuit by closing a battery door of the hearing aid, the timing circuit 54 simultaneously applies a control voltage (denoted Ctrl) to the gate of the voltage-controlled transistor switch 15, effectively connecting the input terminal $V_{ref1}$ to the terminal $V_{in}$. The reference voltage at the terminal $V_{ref1}$ is thus applied to the noninverting input of the first operational amplifier 18, the drain of the low-leakage current transistor 16 and the first terminal of the capacitor 17, respectively, and the capacitor 17 is thus charged with the reference voltage present at the terminal $V_{ref}$.

When the timing circuit 54 times out, the control voltage Ctrl is removed from the gate of the voltage-controlled transistor switch 15, effectively disconnecting the terminal $V_{ref1}$ from the terminal $V_{in}$. The charge voltage present on the plate of the capacitor 17 is now used for reference voltage. The capacitor 17 is discharged in a controlled manner through the low-leakage current transistor 16, slowly reducing this reference voltage towards zero while discharging the current $I_{off}$. The low-leakage current transistor 16 is selected so as to have a very low leakage current, e.g. 10% of the leakage current of the second output transistor 23 (see FIG. 2), in order to draw as small a current as possible, thus reducing the load on the discharging circuit on the current mirror voltage reference. The capacitance of the capacitor 17 and the characteristics of the low-leakage current transistor 16 is selected in order to discharge the capacitor 17 with a velocity smaller than, or equal to, the velocity of the control loop of the second regulator 12 (see FIG. 2).

Figure 4:
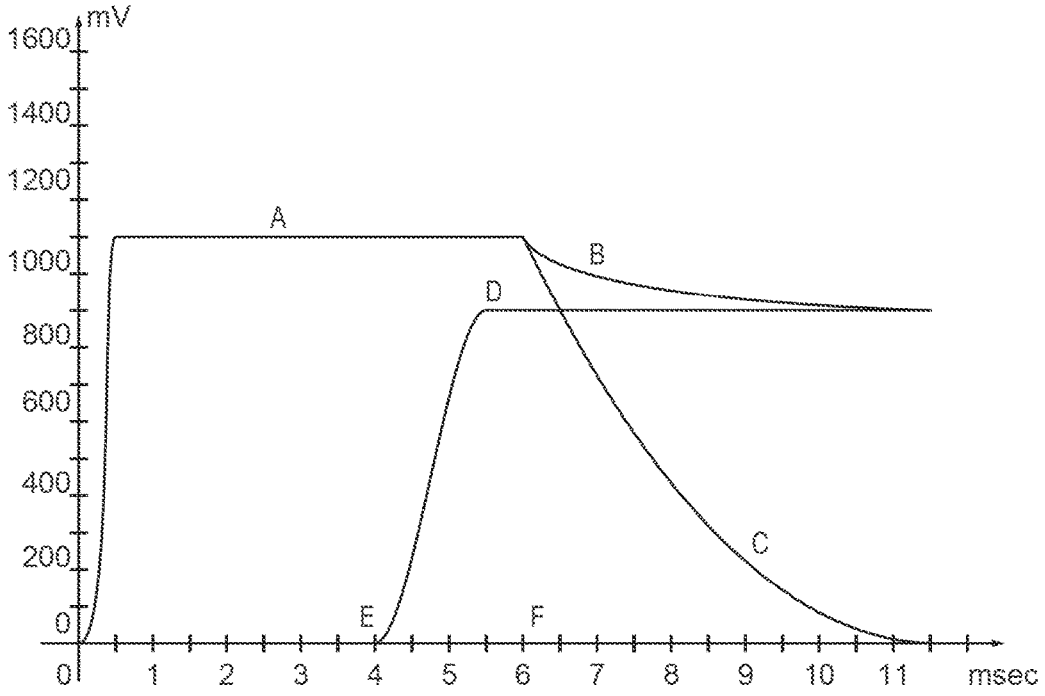
FIG. 4 is a timing diagram showing a startup sequence of the circuit shown in FIG. 2.

FIG. 4 is a timing diagram showing a startup sequence of an exemplary hearing aid power supply circuit of the type shown in FIG. 2. The startup sequence shows the operation of the power supply circuit posterior to the application of battery power. The curve segment marked A in FIG. 4 illustrates the output voltage over time of the first linear voltage regulator 11 in FIG. 2. The output voltage starts at zero and rises within 500 μs to a voltage level of about 1100 mV. The slow-reacting subcircuit 30 is starting to operate after approximately 4 ms, illustrated by the point E in FIG. 4, while the voltage level of 1100 mV is maintained by the first linear voltage regulator 11. The second linear voltage regulator 12 is operating at nominal level after about 5.5 ms, illustrated by the point D in FIG. 4. The nominal voltage level output by the second linear voltage regulator 12 is approximately 900 mV, as illustrated by the curve below the point D in FIG. 4. At this time, the voltage contributed by the first linear voltage regulator 11 may be safely turned off.

The simple voltage reference 13 is disconnected from the first linear voltage regulator in FIG. 2 about 6 ms after battery power is applied, illustrated by the point F in FIG. 4. At this point in time, the output voltage from the dual linear voltage regulator 10 will begin to drop slowly from the 1100 mV provided by the first linear voltage regulator 11 to the 900 mV provided by the second linear voltage regulator 12, illustrated by the curve segment B in FIG. 4. After a period of approximately 11.5 ms has elapsed, the second linear voltage regulator 12 has taken over completely from the first linear voltage regulator 11, which has shut down completely. The open-circuit voltage contribution from the first linear voltage regulator 11 over time is illustrated by the curve segment C in FIG. 4.

All the voltage levels and timings shown in FIG. 4 are exemplary. The accuracy of the output voltage from the first linear voltage regulator 11 is about 20%, the accuracy of the output voltage from the second linear voltage regulator 12 is about 2%, and the timing values may also vary, e.g. with different loads being presented to the power supply circuit 10. Different loads may, for instance, be the result of various parts of the hearing aid circuit being turned on or off. If a power-consuming subcircuit, e.g. an acoustic feedback cancellation circuit or a radio transceiver, are turned on or off in the hearing aid, this may have a significant impact on the timing values shown in FIG. 4.

Figure 5:
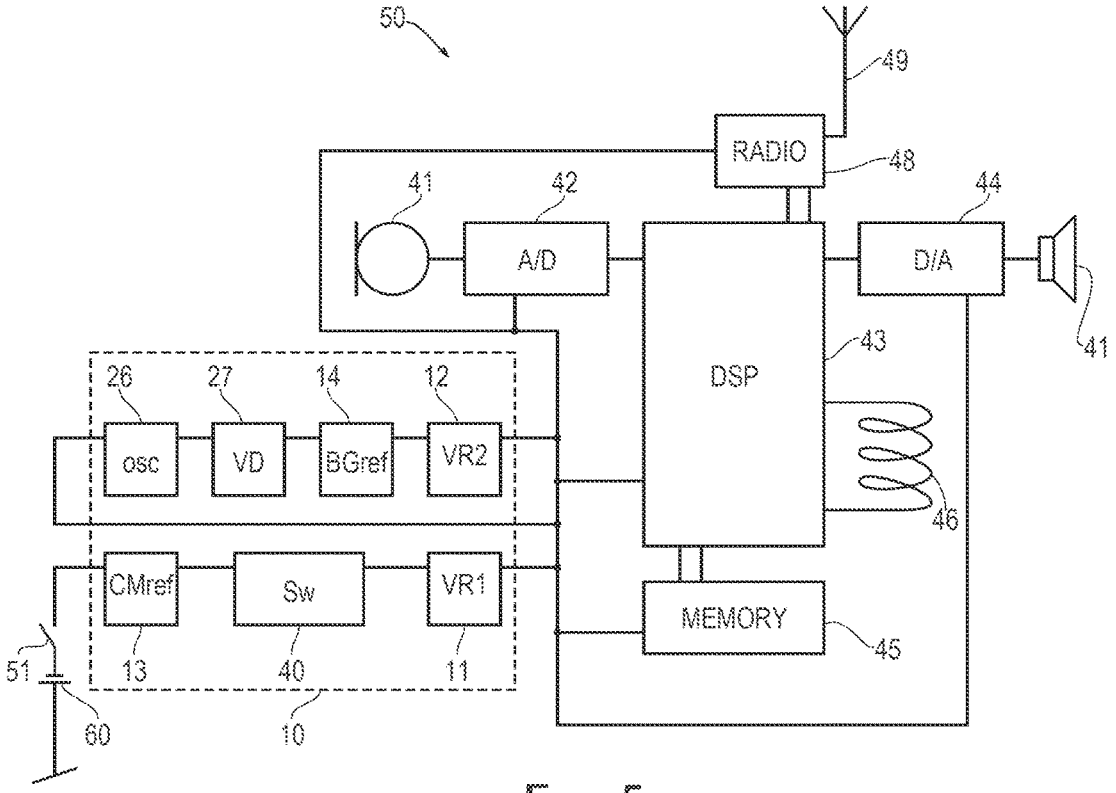
FIG. 5 is an exemplary block schematic diagram of a hearing aid circuit incorporating the voltage regulator in FIG. 2.

FIG. 5 is a simplified block schematic of an exemplified hearing aid 50 comprising a power supply 10 of the type shown in FIG. 2. The hearing aid 50 comprises a digital signal processor 43, a microphone 41, an analog-to-digital converter 42, a digital-to-analog converter 44, an acoustic output converter or loudspeaker 47, a memory bank 45, a telecoil 46, a battery 60, a master clock oscillator 26, a voltage doubler 27, a band-gap voltage reference 14, a simple voltage reference 13, a discharge circuit 40, a first linear voltage regulator 11, a second linear voltage regulator 12, a wireless radio transceiver 48, and an antenna 49.

The digital signal processor 43 is the main functional block in the hearing aid 50, providing amplification, compression, acoustic feedback suppression and source selection of a range of input signals for the benefit of a hearing aid user, including a digitized signal from the microphone 41 via the analog-to-digital converter 42, a signal from the telecoil 46 and an audio stream received by the wireless radio transceiver 48. The processed signals are fed to the digital-to-analog converter 44 feeding an analog signal to the loudspeaker 47 for acoustic reproduction by the hearing aid 50.

During use, the digital signal processor 43 may operate in a number of different modes or programs according to the requirements of a hearing aid user. The digital signal processor DSP may provide a selection of signal processing algorithms for performing alleviating amplification in order to compensate for a hearing loss. One program may incorporate several different signal processing algorithms operating simultaneously in order to perform a desired function.

The various programs may be stored in the memory bank 45 for later retrieval by the hearing aid user. The wireless radio transceiver 48 may be used for receiving programming information, e.g. user specific parameter settings tailored by a hearing aid professional in order to compensate an individual hearing loss, it may receive remote control commands from a remote control (not shown), e.g. for volume changes or program selection in the hearing aid 50, or it may be used for receiving an audio stream from an external source for acoustic reproduction by the hearing aid 50 to the benefit of the hearing aid user. All electronic subcircuits of the hearing aid draw their power from the power supply 10. In turn, the power supply 10 draws its power from the hearing aid battery 60, said battery being e.g. of the zinc-air variety or the lithium-polymer variety according to the requirements of the hearing aid 50.

When the hearing aid 50 is powered on by closing the on/off switch 51, e.g. by closing the door of the hearing aid battery compartment, the battery 60 immediately provides a battery voltage Vbat to the power supply 10. However, the slow-reacting subcircuit 30 is not considered operational until a predetermined condition is fulfilled, such as the condition that a period of time has elapsed, e.g. 5 milliseconds, since the moment the on/off switch 51 has been closed. During that period of time, power is delivered by the first linear voltage regulator 11, the voltage being regulated based on the simple voltage reference 13 via the discharging circuit 40.

When an appropriate period of time has elapsed, e.g. 5 milliseconds, the discharge circuit 40 disconnects the simple voltage reference 13 from the first linear voltage regulator 11, thus causing its voltage contribution to drop gradually to 0 volts over a period of a couple of milliseconds. Then, the slow-reacting subcircuit 30 is considered to having reached its nominal operating level, and the second linear voltage regulator 12 is now capable of providing the supply voltage for the hearing aid subcircuits based on the voltage level of the band-gap voltage reference 14. The discharge circuit 40 may therefore disconnect the simple voltage reference 13 in order to save battery power, and thanks to the constructional details discussed in conjunction with FIGS. 3 and 4 be capable of reducing the contribution from the first linear voltage regulator 11 sufficiently slowly for the control loop of the second linear voltage regulator 12 to be able to compensate, thus maintaining the supply voltage level within 2% during normal operation of the hearing aid 50.

Figure 6:
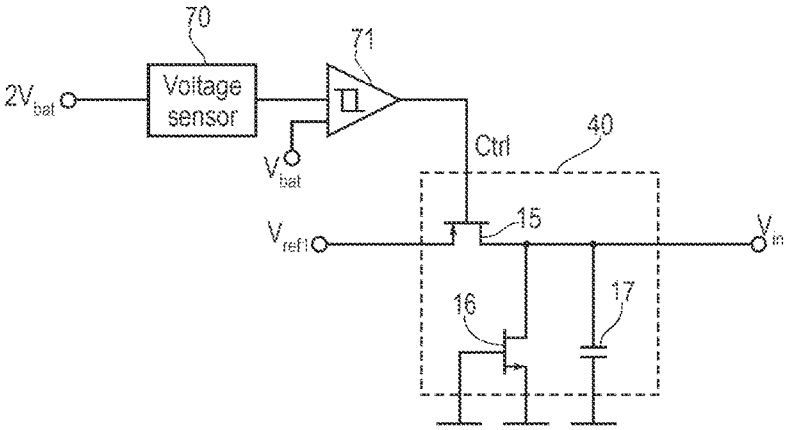
FIG. 6 is an exemplary schematic diagram of an alternative embodiment of the discharging circuit in FIG. 3.

FIG. 6 shows an exemplary embodiment of a discharging circuit 40 similar to the circuit shown in FIG. 3. Like the embodiment shown in FIG. 3, this embodiment comprises the voltage-controlled transistor switch 15, the low-leakage current transistor 16 and the capacitor 17. In this embodiment, a voltage sensor 70 and a comparator 71 provides the input to the voltage-controlled transistor switch 15. The voltage sensor is fed the output voltage $2*V_{bat}$ from the voltage doubler 27 (not shown in FIG. 6), and provides a detectable, proportional voltage, e.g. $V_{bat}$, to the comparator 71. When the output voltage from the voltage doubler 27 has reached $2*V_{bat}$, the output voltage from the voltage sensor 70 will have reached $V_{bat}$, and the comparator will output a control voltage to the input of the voltage-controlled transistor switch 15, which will turn off, thus disconnecting $V_{ref1}$ from $V_{in}$. This will start the discharging of the charge present in the capacitor 17 through the low-leakage current transistor 16, slowly reducing $V_{in}$ to zero. The circuit shown in FIG. 6 is thus capable of turning off the first voltage regulator in the controlled manner described in the foregoing when the voltage doubler 27 is providing a properly doubled voltage.

Although the above embodiments have been described with reference to the voltage regulators being linear voltage regulators, in other embodiments, the voltage regulators may be non-linear voltage regulators, or other types of voltage regulators.

The skilled person will appreciate that the design of the hearing aid power supply may be varied in several ways without leaving the scope of the disclosed power supply as defined by the claims.

Although particular exemplary earmolds have been shown and described, it will be understood that it is not intended to limit the claimed inventions to the exemplary earmolds, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. An apparatus for a hearing device, comprising:
- a first voltage regulator with an output terminal;
- a first voltage reference;
- a second voltage regulator with an output terminal;
- a switching element; and
- a decoupling element coupled downstream with respect to the switching element;
- wherein the switching element and the decoupling element are operatively coupled to the first voltage reference and the first voltage regulator;
- wherein the first voltage regulator is configured to provide a first output voltage in response to applied battery power, the second voltage regulator is configured to provide a second output voltage if a certain condition is fulfilled, and the switching element is configured to disconnect the first voltage reference from the decoupling element if the condition is fulfilled; and
- wherein the first voltage regulator and the second voltage regulator are separate individual components and are configured to provide the first output voltage and the second output voltage, respectively, during at least a part of an operation period of the hearing device.

2. The apparatus according to claim 1, wherein the decoupling element comprises a capacitor coupled to an output side of the switch element.

3. The apparatus according to claim 1, wherein the switching element is a semiconductor switching element.

4. The apparatus according to claim 1, wherein the condition is a presence of a predetermined voltage level at a specified node in the apparatus.

5. The apparatus according to claim 1, wherein the first voltage reference is a current mirror voltage reference.

6. The apparatus according to claim 1, further comprising a second voltage reference connected to the second voltage regulator, wherein the second voltage reference is a band-gap voltage reference.

7. The apparatus according to claim 1, wherein the second voltage regulator is configured to provide a more precise output voltage than the first voltage regulator.

8. The apparatus according to claim 1, wherein the second output voltage provided by the second voltage regulator deviates less than 2% from a nominal output voltage.

9. The apparatus according to claim 1, wherein the second output voltage provided by the second voltage regulator is at least ten times more accurate than the first output voltage provided by the first voltage regulator.

10. The apparatus of claim 1, wherein the first voltage regulator is configured to provide the first output voltage for the hearing device at startup of the hearing device, before and/or while a sub-circuit in the hearing device starts up; and wherein the second voltage regulator is configured to provide the second output voltage for the hearing device after the sub-circuit is started up.

11. The apparatus according to claim 1, wherein the condition is considered as being fulfilled when a predetermined time period measured from an application of battery power has lapsed.

12. The apparatus according to claim 1, wherein the output terminal of the first voltage regulator shares a same electrical node as the output terminal of the second voltage regulator; and wherein the first voltage regulator and the second voltage regulator are configured to provide the first output voltage and the second output voltage, respectively, to the same electrical node simultaneously during the at least a part of the operation period of the hearing device.

13. The apparatus according to claim 1, wherein the switching element comprises a transistor switch having a switch input and a switch output; and wherein the decoupling element comprises a capacitor coupled to the switch output of the transistor switch.

14. The apparatus according to claim 13, further comprising a transistor coupled to the switch output of the transistor switch.

15. An apparatus for a hearing device, comprising:

a first voltage regulator with an output terminal;

a first voltage reference;

a second voltage regulator with an output terminal;

a switching element; and a decoupling element;

wherein the switching element and the decoupling element are operatively coupled to the first voltage reference and the first voltage regulator;

wherein the first voltage regulator is configured to provide a first output voltage in response to applied battery power, the second voltage regulator is configured to provide a second output voltage if a certain condition is fulfilled, and the switching element is configured to disconnect the first voltage reference from the decoupling element if the condition is fulfilled; and wherein the first voltage regulator and the second voltage regulator are separate individual components and are configured to provide the first output voltage and the second output voltage, respectively, during at least a part of an operation period of the hearing device; and wherein the condition is that a predetermined time period has elapsed since an application of battery power.

16. The apparatus according to claim 15, wherein the predetermined time period is anywhere from 3 ms to 10 ms.

17. The apparatus according to claim 15, wherein the predetermined time period is anywhere from 4 ms to 6 ms.

18. An apparatus for a hearing device, comprising:

a first voltage regulator with an output terminal;

a first voltage reference;

a second voltage regulator with an output terminal;

a switching element; and a decoupling element;

wherein the switching element and the decoupling element are operatively coupled to the first voltage reference and the first voltage regulator;

wherein the first voltage regulator is configured to provide a first output voltage in response to applied battery power, the second voltage regulator is configured to provide a second output voltage if a certain condition is fulfilled, and the switching element is configured to disconnect the first voltage reference from the decoupling element if the condition is fulfilled; and wherein the first voltage regulator and the second voltage regulator are separate individual components and are configured to provide the first output voltage and the second output voltage, respectively, during at least a part of an operation period of the hearing device;

wherein the condition is a presence of a predetermined voltage level at a specified node in the apparatus; and wherein the predetermined voltage level is a multiple of a nominal battery voltage.

19. An apparatus for a hearing device, comprising:

a first voltage regulator with an output terminal;

a first voltage reference;

a second voltage regulator with an output terminal;

a switching element; and a decoupling element;

wherein the switching element and the decoupling element are operatively coupled to the first voltage reference and the first voltage regulator;

wherein the first voltage regulator is configured to provide a first output voltage in response to applied battery power, the second voltage regulator is configured to provide a second output voltage if a certain condition is fulfilled, and the switching element is configured to disconnect the first voltage reference from the decoupling element if the condition is fulfilled; and wherein the first voltage regulator and the second voltage regulator are separate individual components and are configured to provide the first output voltage and the second output voltage, respectively, during at least a part of an operation period of the hearing device;

wherein a timing constant of the decoupling element is larger than, or equal to, a timing constant of a control loop of the second voltage regulator.

20. An apparatus for a hearing device, comprising:

a first voltage regulator;

a second voltage regulator;

a sub-circuit coupled to an input to the second voltage regulator;

a switching element; and a decoupling element coupled downstream with respect to the switching element;

wherein the first voltage regulator is configured to provide a first output voltage for the hearing device at startup of the hearing device, at least before the sub-circuit starts up; and wherein the second voltage regulator is configured to provide a second output voltage for the hearing device after the sub-circuit is started up.

21. The apparatus of claim 20, wherein the second voltage regulator is configured to provide the second output voltage while the first voltage regulator is being turned off.

22. The apparatus of claim 20, wherein during normal operation of the hearing device, the second voltage regulator is idle.

23. The apparatus of claim 20, wherein the second voltage regulator is configured to provide the second output voltage after a predetermined time period has elapsed since the first output voltage is provided by the first voltage regulator.

24. The apparatus of claim 23, wherein the predetermined time period is anywhere from 3 ms to 10 ms.

25. The apparatus of claim 23, wherein the predetermined time period is anywhere from 4 ms to 6 ms.

26. The apparatus of claim 23, wherein the first voltage regulator is configured to be turned off after the second output voltage from the second voltage regulator reaches a stable level.

27. The apparatus of claim 20, wherein first voltage regulator and the second voltage regulator are configured to operate with each other so that a power supply for the hearing device has a first power level before the sub-circuit starts up, and gradually decreases to a second power level after the sub-circuit is started up.

28. The apparatus of claim 20, wherein the first voltage regulator has an output terminal, the second voltage regulator has an output terminal, and the output terminal of the first voltage regulator shares a same electrical node as the output terminal of the second voltage regulator.

29. The apparatus of claim 20, further comprising:

a first voltage reference;

wherein the switching element and the decoupling element are operatively coupled to the first voltage reference and the first voltage regulator.

30. The apparatus of claim 29, wherein the first voltage regulator is configured to provide the first output voltage in response to applied battery power.

31. The apparatus of claim 29, wherein the switching element is configured to disconnect the first voltage reference from the decoupling element if a condition is fulfilled.

32. The apparatus of claim 20, wherein the first voltage regulator and the second voltage regulator are configured to provide the first output voltage and the second output voltage, respectively, to a same electrical node simultaneously during at least a part of an operation period of the hearing device.

33. The apparatus according to claim 20, wherein the switching element comprises a transistor switch having a switch input and a switch output; and wherein the decoupling element comprises a capacitor coupled to the switch output of the transistor switch.

34. The apparatus according to claim 33, further comprising a transistor coupled to the switch output of the transistor switch.

35. An apparatus for a hearing device, comprising:

a first voltage regulator with an output terminal;

a first voltage reference;

a second voltage regulator with an output terminal;

a switching element; and a decoupling element coupled downstream with respect to the switching element;

wherein the switching element and the decoupling element are operatively coupled to the first voltage reference and the first voltage regulator; and wherein the first voltage regulator is configured to provide a first output voltage in response to applied battery power, the second voltage regulator is configured to provide a second output voltage if a condition is fulfilled, the second output voltage being independent of the first output voltage.

36. The apparatus of claim 35, wherein the switching element is configured to disconnect the first voltage reference from the decoupling element if the condition is fulfilled.

37. The apparatus of claim 35, wherein the first voltage regulator and the second voltage regulator are configured to provide the first output voltage and the second output voltage, respectively, to a same electrical node simultaneously during at least a part of an operation period of the hearing device.

38. The apparatus of claim 35, wherein the first voltage regulator and the second voltage regulator are separate individual components.

39. The apparatus of claim 35, wherein the first voltage regulator is configured to provide a first output voltage for the hearing device at startup of the hearing device, at least before a sub-circuit starts up.

40. The apparatus according to claim 35, wherein the switching element comprises a transistor switch having a switch input and a switch output; and wherein the decoupling element comprises a capacitor coupled to the switch output of the transistor switch.

41. The apparatus according to claim 40, further comprising a transistor coupled to the switch output of the transistor switch.

* * * * *